US010786434B2

(12) United States Patent
Casner

(10) Patent No.: US 10,786,434 B2
(45) Date of Patent: Sep. 29, 2020

(54) TABLET SPLITTER

(71) Applicant: Erin Keeley Casner, Carrollton, MO (US)

(72) Inventor: Erin Keeley Casner, Carrollton, MO (US)

( * ) Notice: Subject to any disclaimer, the term of this patent is extended or adjusted under 35 U.S.C. 154(b) by 0 days.

(21) Appl. No.: 16/223,430

(22) Filed: Dec. 18, 2018

(65) Prior Publication Data

US 2020/0188231 A1 Jun. 18, 2020

(51) Int. Cl.
*A61J 7/00* (2006.01)
*B26F 3/00* (2006.01)

(52) U.S. Cl.
CPC ..... *A61J 7/0007* (2013.01); *B26F 3/002* (2013.01)

(58) Field of Classification Search
CPC ..... A61J 7/0007; Y10T 225/371; Y10T 225/379; Y10T 225/10; Y10T 225/30; B26F 3/002; B23D 31/002; B26D 3/30; B26D 7/01
USPC ..... 30/124
See application file for complete search history.

(56) References Cited

U.S. PATENT DOCUMENTS 3,517,871 A * 6/1970 Gaffney ..... A61J 7/0007 225/103
3,815,802 A * 6/1974 Stevens ..... A61J 7/0007 225/93
4,173,826 A * 11/1979 Leopoldi ..... A61J 7/0007 225/103
4,179,806 A * 12/1979 Lieptz ..... A61J 7/0007 206/528
4,330,936 A * 5/1982 Swarth ..... A61J 7/0007 225/103
4,473,192 A * 9/1984 Urban ..... A61J 7/0007 241/168
4,697,344 A * 10/1987 Leopoldi ..... A61J 7/0007 225/103
4,887,755 A * 12/1989 Gibilisco ..... A61J 7/0007 225/103
D310,731 S * 9/1990 Lieptz ..... D24/101
5,038,475 A * 8/1991 Wolff ..... A61J 7/0007 225/103
5,118,021 A * 6/1992 Fiocchi ..... A61J 7/0007 225/103
6,342,248 B1 * 1/2002 Miyabe ..... A61J 1/035 206/532
D468,023 S * 12/2002 Buckley ..... D24/220
6,557,945 B1 * 5/2003 Eric ..... A61J 7/0007 30/124
6,601,746 B2 8/2003 Buckley et al.
7,000,815 B1 * 2/2006 Tipton ..... A61J 7/0007 225/103

(Continued)

FOREIGN PATENT DOCUMENTS

WO 2015164142 A1 10/2015

*Primary Examiner* — Evan H MacFarlane
(74) *Attorney, Agent, or Firm* — Avant Law Group, LLC

(57) ABSTRACT

A tablet splitter has a top portion that includes a splitting wedge with first and second angled sides defining a leading edge, and a bottom portion that includes a platform. The platform has a flexible matrix and a flexible tablet stabilizer disposed atop the flexible matrix for holding a tablet. The leading edge of the splitting wedge contacts the tablet and causes the flexible matrix and the flexible tablet stabilizer to flex thereunder. The tablet splits in response to the contact with the splitting wedge upon receiving a sufficient amount of force.

18 Claims, 4 Drawing Sheets

(56) References Cited

U.S. PATENT DOCUMENTS 7,243,826 B2 7/2007 Darst
7,275,671 B1 * 10/2007 Reitano ..... A61J 7/0007 225/23
7,828,181 B1 * 11/2010 Reitano ..... B26D 3/30 225/1
8,430,287 B2 4/2013 Sze
10,420,706 B2 * 9/2019 Lee ..... B26D 3/30
2002/0179666 A1 * 12/2002 Buckley ..... A61J 7/0007 225/1
2002/0179669 A1 * 12/2002 Buckley ..... A61J 7/0007 225/103
2003/0019900 A1 * 1/2003 Dienst ..... A61J 7/0007 225/104
2005/0067452 A1 * 3/2005 Darst ..... A61J 7/0007 225/103
2006/0201985 A1 * 9/2006 Sze ..... A61J 7/0007 225/104
2008/0011803 A1 * 1/2008 Petrie ..... B26D 3/30 225/103
2009/0183373 A1 * 7/2009 Suhr ..... A61J 7/0007 30/124
2011/0271530 A1 * 11/2011 Raghuprasad ..... B26D 3/30 30/124
2012/0060374 A1 * 3/2012 Noble ..... A61J 7/0007 30/124
2014/0021276 A1 * 1/2014 Young ..... B02C 19/08 241/25
2014/0311304 A1 * 10/2014 Noble ..... A61J 7/0007 83/13
2015/0209236 A1 * 7/2015 Patel ..... A61J 7/0007 225/103
2017/0128324 A1 * 5/2017 Muller ..... B26D 3/30
2018/0086518 A1 * 3/2018 Charm ..... B26D 1/0006
2018/0153774 A1 6/2018 Lee
2018/0271751 A1 9/2018 Torres
2019/0060173 A1 * 2/2019 Raghuprasad ..... B26D 7/01

* cited by examiner

TABLET SPLITTER

FIELD OF THE INVENTION

This application relates to tablet splitters. More specifically, this application is directed to tablet splitters that do not use a traditional blade.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, a tablet splitter has a first portion and a second portion. The first portion includes a first side face laterally separated from a second side face, a back face extending between the first and second side faces, and a top face adjacent respective top edges of the first side face, the second side face, and the back face. The first side face, the second side face, the back face, and the top face define a first cavity. A splitting wedge is disposed within the first cavity, and has a pentagonal configuration which defines a leading edge and respective first and second angled faces extending from the leading edge forming an angle therebetween. The second portion includes A first side face laterally separated from a second side face, a back face longitudinally separated from a front face, and each of the back face and the front face extend between the first side face and the second side face. A bottom face is adjacent respective bottom edges of the first side face, the second side face, the front face, and the back face, together defining a second cavity.

A platform is disposed within the second cavity and includes a flexible matrix releasably attached an inside surface of the bottom face, and a tablet stabilizer disposed atop the flexible matrix. The tablet stabilizer has a seat portion for receiving a tablet and a wedge guide, and both the seat portion and the wedge guide are laterally offset from a top edge of the tablet stabilizer. The first portion is hingedly connected to the second portion and is configured to rotate from an open position to a closed position. The splitting wedge contacts the tablet stabilizer at the wedge guide when in the closed position; and the tablet stabilizer comprises a flexible material such that it flexes at the location of the wedge guide when in the closed position.

In another embodiment, a tablet splitter has a top portion that includes a splitting wedge with first and second angled sides defining a leading edge, and a bottom portion that includes a platform. The platform has a flexible matrix and a flexible tablet stabilizer disposed atop the flexible matrix for holding a tablet. The leading edge of the splitting wedge contacts the tablet and causes the flexible matrix and the flexible tablet stabilizer to flex thereunder. The tablet splits in response to the contact with the splitting wedge upon receiving a sufficient amount of force.

In still another embodiment, a method of uniformly splitting a tablet involves first providing a tablet splitter. The tablet splitter has a top portion with a splitting wedge formed of first and second angled sides defining a leading edge, and a bottom portion having a platform comprising a flexible matrix and a flexible tablet stabilizer disposed atop the flexible matrix for holding a tablet. The top portion and the bottom portion of the tablet splitter are operably coupled to one another. Once the tablet splitter is available, a user proceeds by placing the tablet on the flexible tablet stabilizer, moving the top portion such that the leading edge of the splitting wedge contacts the tablet and causes the flexible matrix and the flexible tablet stabilizer to flex thereunder, and providing a sufficient amount of pressure to the top portion until the tablet splits into a first portion and a second portion in response to the contact with the splitting wedge.

DETAILED DESCRIPTION

Figure 1:
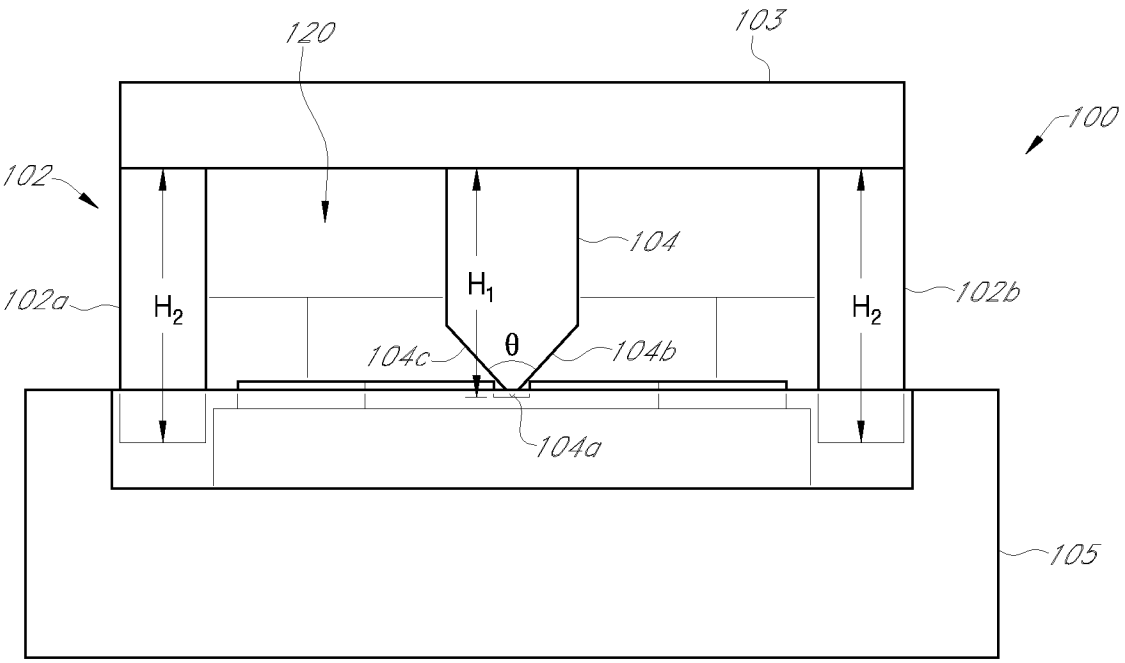
FIG. 1 is a front view of a tablet splitter in a semi-closed configuration according to an embodiment of the invention.

Tablet splitters are well known and frequently used to split medications into doses not readily available for purchase. Most tablet splitters currently available utilize a blade, such as a stainless-steel blade with a sharpened edge, to split the tablet. However, there are many potential problems associated with such bladed tablet splitters. For example, when the blade is new, there is a risk of injury to a user who may unintentionally leave his or her finger in the path of the blade. And as the blade ages, it becomes increasingly dull such that the tablet may be crushed under the blade rather than cut as desired.

Embodiments of tablet splitters are described herein which overcome these, and other, problems associated with previous tablet splitters. Referring now to the figures, according to an embodiment of the invention, a tablet splitter 100 includes a top portion 102 and a bottom portion 105. In embodiments, the top portion 102 and bottom portion 105 may be hingedly connected via a hinge construction 107. The top portion 102 and bottom portion 105 may define respective male and female portions of the hinge 107, which may be secured together by a pin 108. In another embodiment, the top portion 102 and bottom portion 105 are formed of a unitary construction, and the hinge 107 may be formed by an area of weakness between the respective top portion and bottom portion portions 102 and 105. In still another embodiment, the hinge 107 is a component separate from, and fastened to, the respective top portion and bottom portion portions 102 and 105 so as to unite the portions 102 and 105 together. In a further embodiment, the top portion 102 is entirely separate from the bottom portion 105.

Figure 2:
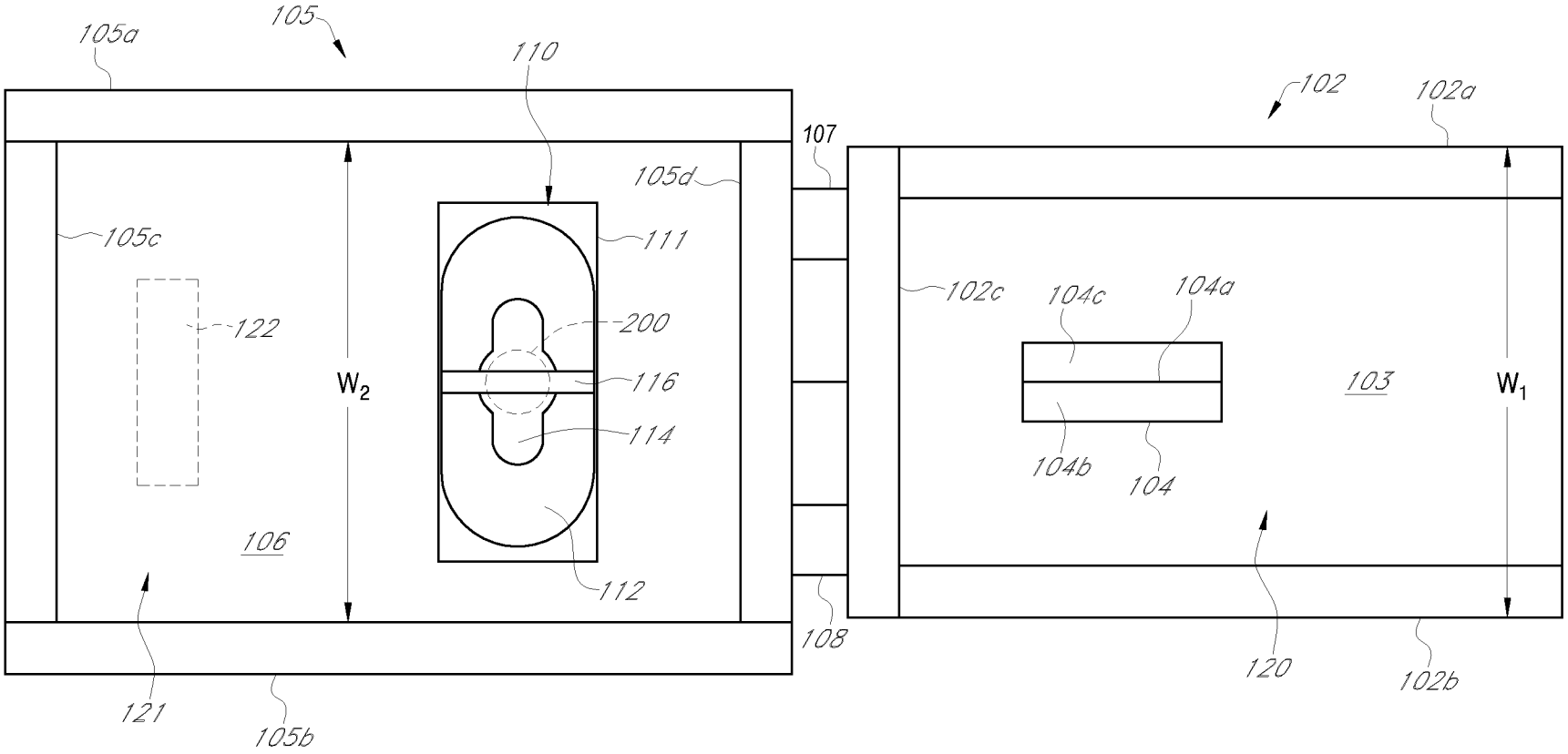
FIG. 2 is a top view of the tablet splitter of FIG. 1 in an open configuration.

The top portion 102 may include a first side face 102*a* spatially separated from a second side face 102*b*, which are connected at a respective end by a back-side face 102*c*. Optionally, the top portion 102 may additionally include a front face. The hinge 107, if present, is adjacent to (or integral with) the back-side face 102*c* as shown in FIG. 2. A top face 103 is disposed atop respective top edges of the side faces 102*a*, 102*b*, and 102*c*. The side faces 102*a*, 102*b*, and 102*c* extend from an underside of the top face 103 to form a cavity 120. The top portion 102 has an outer width W1 configured to fit within, or be substantially equal to, an inner width W2 of the bottom portion 105 as described below. Optionally, the top face 103 may have an aesthetic design. In an embodiment, a top cover may be configured to temporarily attach to the top face 103, and the cover may be customized on a user's aesthetic preferences.

A splitting wedge 104 is disposed within the cavity 120, and secured to the underside of the top face 103. In embodiments, the splitting wedge 104 is integral with, or forms a unitary portion of, the top face 103. In other embodiments, the splitting wedge 104 is separate from, but attached to the underside of the top face 103 (e.g., via an adhesive, weld, fastener, and the like). The splitting wedge 104 has a pentagonal configuration defining a leading edge 104*a* and forming an angle θ between respective inclined surfaces 104*b* and 104*c*. The angle θ is preferably, though not necessarily, an acute angle (e.g., less than or equal to about 90 degrees). In embodiments, the angle θ is between about 20 and 90 degrees, between about 30 and 90 degrees, between about 45 and 90 degrees, between about 60 and 90 degrees, for example. According to one embodiment, the angle θ is about 80, 85, or 90 degrees. According to still another embodiment, the angle θ is an obtuse angle, and is greater than about 90 degrees and less than about 180 degrees.

Moving on, the bottom portion 105 includes a first side face 105*a* spatially separated from a second side face 105*b*. The respective side faces 105*a* and 105*b* are connected by longitudinally separated front face 105*c* and back face 105*d*. A bottom face 106 underlies and is connected to respective bottom edges of the faces 105*a*, 105*b*, 105*c*, and 105*d*. The side faces 105*a* and 105*b*, the front face 105*c*, the back face 105*d*, and the bottom face 106 define a cavity 121. The cavity 121 has a width W2 that is substantially equal to the outer width W1 of the top portion 102 (although the width W2 may be slightly larger than the width W1 to allow for ease in mating the top portion 102 to the bottom portion 105).

A platform 110 is disposed within the cavity 121. The platform 110 is substantially centrally located along the width W2 of the cavity 121, and the respective side faces 102*a* and 102*b* of the top portion 102 may fit within spaces defined between the platform 110 and the side faces 105*a* and 105*b* of the bottom portion 105 when in a closed configuration (see FIG. 1). A height H1 of the splitting wedge 104 may be such that it comes into contact with a platform 110 as described below. Accordingly, in embodiments, the height H1 (FIG. 1) of the splitting wedge 104 may be less than a height H2 of the respective first and second side faces 102*a* and 102*b*. However, in embodiments the height H1 of the splitting wedge 104 may be substantially similar to the height H2 of the respective first and second side faces 102*a* and 102*b*.

The platform 110 includes a cushion 111 and a tablet stabilizer 112. The cushion 111 is a flexible matrix formed of a flexible material, such as a foam, rubber, or other elastomeric material. The cushion 111 may be removably adhered to the bottom face 106 such that the cushion 111 (either alone or together with the tablet stabilizer 112) can be replaced if necessary. The tablet stabilizer 112 is disposed atop the cushion 111 and may be adhered thereto to prevent the tablet stabilizer 112 from shifting.

Figure 3:
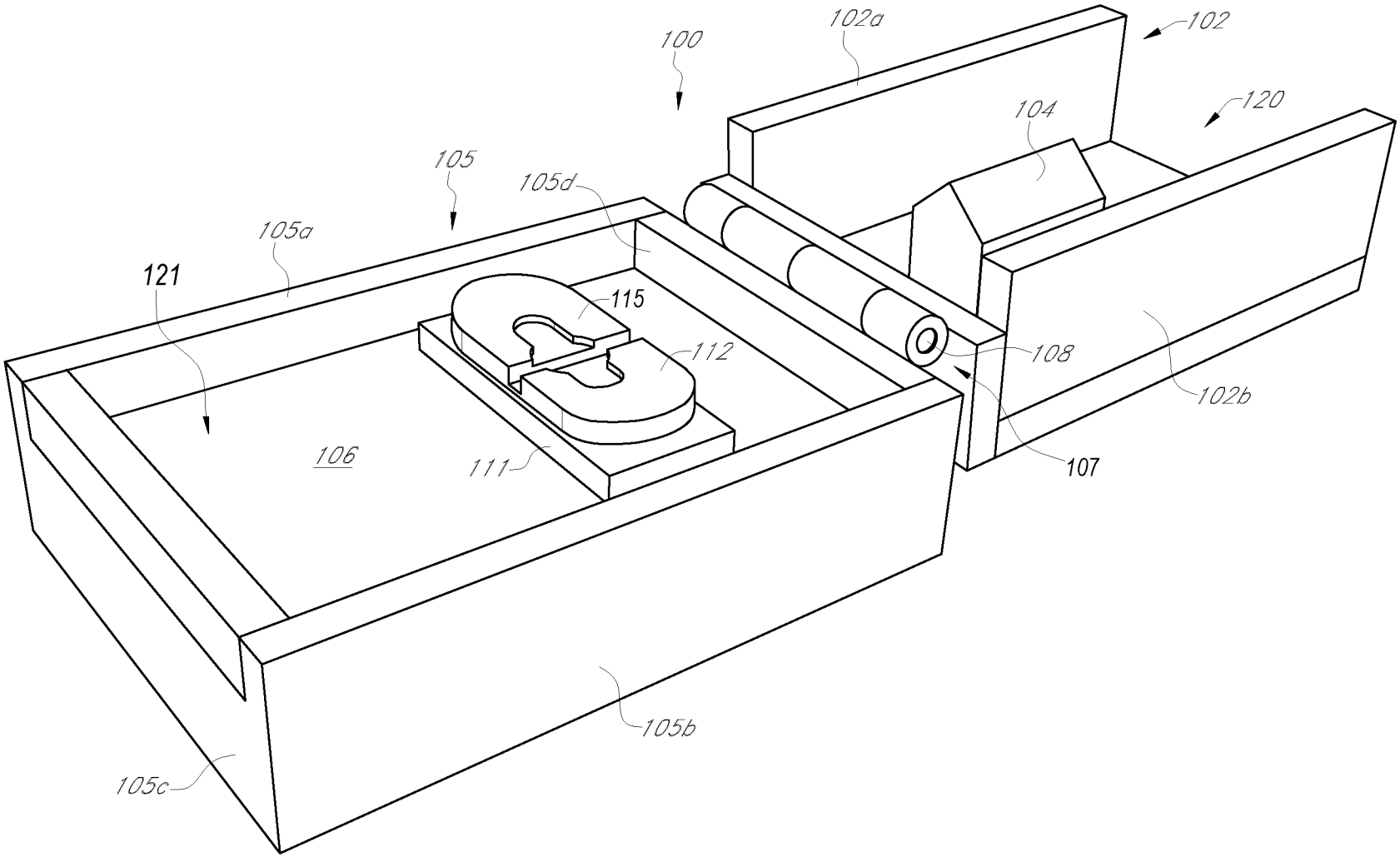
FIG. 3 is a perspective view of the tablet splitter of FIG. 2.

The tablet stabilizer 112 may have an oblong shape, although such a shape is not required. The stabilizer 112 includes an inner seat portion 114 which may be slightly vertically offset from a top edge 115 of the stabilizer 112. The top edge 115 defines a first pair of planar upper surfaces as can be seen in FIGS. 2 and 3, which first pair of planar surfaces are on opposing sides of the wedge guide 116. The inner seat portion 114 defines a second pair of planar lower surfaces as can be seen in FIGS. 2 and 3, which second pair of planar surfaces are on opposing sides of the wedge guide 116. The wedge guide 116 is defined by a groove as can be seen in FIGS. 2 and 3. The seat portion 114 is configured to hold a tablet within the stabilizer 112 during use, and may include an oblong portion and a substantially circular portion. The tablet stabilizer 112 may be molded or otherwise manufactured of a firm yet flexible material, such as a thermoplastic material. Other materials may additionally; or alternately, be utilized.

Figure 4:
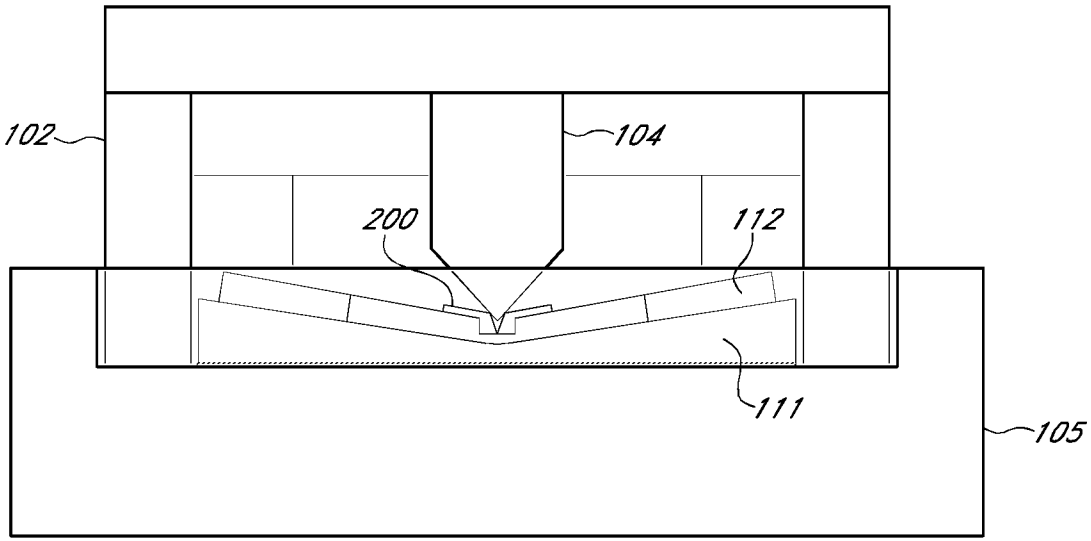
FIG. 4 is a front view of the tablet splitter in a use configuration.

A wedge guide 116 may be formed transversely down the center of the stabilizer 112. The wedge guide 116 may be further vertically offset from the inner seat portion 114. In a closed position, as shown in FIG. 1, the leading edge 104*a* of the wedge 104 is substantially received into the wedge guide 116. Preferably, the tablet is placed on the stabilizer 112 such that the score line (or mid line), if any, is aligned with the wedge guide 116 and the tablet breaks along the score line when pressure is applied to the wedge 104. As shown in FIG. 4, when the wedge 104 comes into contact with a tablet on tablet stabilizer 112, the stabilizer 112 flexes under the wedge 104. The cushion 111 provides the support necessary to allow the stabilizer to flex 112 under pressure; however, once pressure is removed from the stabilizer 112, the cushion 111 urges the stabilizer 112 back to a substantially horizontal position. Because of the flexibility of the stabilizer 112 and the cushion 111, instead of cutting through a tablet like prior art splitters, the tablet breaks along the line of contact with the leading edge 104*a* of the wedge 104. Specifically, the cushion 111 provides sufficient pressure from the underside of the tablet on either side of the center of the tablet.

Surprisingly, it was found that providing a flexible matrix upon which the tablet rests, and utilizing a wedge rather than a blade, causes less crushing than traditional splitters. Additionally, it was found that the tablets split more evenly than with traditional splitters. This is important, as it is often crucial that a recipient receive as close as possible to the exact dosage of a medication as prescribed by a doctor. Where there is significant crushing, or where the user fails to split the tablet evenly, the user may be taking the wrong dose of medication.

Optionally, a tablet holding area 122 may be formed in the cavity 121 forward of the platform 110 for holding split tablets. This may be preferable for users who split several tablets at a time. The user may be able to split a tablet, move the tablet to the holding area 122, and then proceed with splitting additional tablets. Or, the tablet holding area 122 may simply hold the sections of the tablet until the user ingests the section of the tablet.

It shall be understood by those of skill in the art that the tablet splitter 100, including the top portion 102, the bottom portion 105, and the wedge 104, may be formed from any material suitable to allow the splitter 100 to operate for its intended purpose. In one embodiment, the tablet splitter is formed of a high impact plastic.

A method for operating the tablet splitter 100 according to an embodiment of the invention includes placing a tablet 200 on the platform 110, preferably on the tablet stabilizer 112 in the area of the inner seat portion 114. If the tablet 200 has a center line or an area of weakness, the area of weakness may be aligned with the wedge guide 116. The user may then rotate the top portion 102 about the hinge 107 to bring the wedge 104 into contact with the tablet 200. The user then exerts sufficient force on the top portion 102 to force the tablet 200 downwards towards the cushion 111. The cushion 111 exerts an opposing force on the tablet 200 (and specifically on either side of the center portion) causing the tablet 200 to split into first and second portions. Preferably, the first and second portions are substantially equal. The user may remove the portions of the tablet 200 from the tablet splitter 100, or store the portions in the holding area 122 for later use. In embodiments, the user may further split one or more of the portions tablet into additional portions as necessary.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention.

Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

What is claimed is:

1. A tablet splitter, comprising:

a first portion, comprising:

a first side face laterally separated from a second side face;

a back face extending between the first and second side faces; and a top face adjacent respective top edges of the first side face, the second side face, and the back face, wherein the first side face, the second side face, the back face, and the top face define a first cavity; and a splitting wedge disposed within the first cavity, the splitting wedge having a pentagonal configuration defining a leading edge and respective first and second angled faces extending from the leading edge forming an angle therebetween; and a second portion, comprising:

a first side face laterally separated from a second side face;

a back face longitudinally separated from a front face, each extending between the first side face of the second portion and the second side face of the second portion; and a bottom face adjacent respective bottom edges of the first side face of the second portion, the second side face of the second portion, the front face of the second portion, and the back face of the second portion, wherein the first side face of the second portion, the second side face of the second portion, the front face of the second portion, the back face of the second portion, and the bottom face of the second portion define a second cavity; and a platform disposed within the second cavity, the platform comprising:

a flexible matrix attached to an inside surface of the bottom face;

a tablet stabilizer disposed atop the flexible matrix, the tablet stabilizer comprising:

a first pair of planar surfaces;

a second pair of planar surfaces offset from and parallel to the first pair of planar surfaces; and a groove intersecting the respective first and second pairs of planar surfaces;

wherein:

the second pair of planar surfaces defines a seat portion for receiving a tablet; and the groove defines a wedge guide;

wherein:

the first portion is connected to the second portion via a hinged connection, whereby the first portion is rotatable from an open position to a closed position;

the splitting wedge contacts the tablet stabilizer at the wedge guide when in the closed position; and the tablet stabilizer is made of a flexible material configured to flex at the location of the wedge guide when the first portion is in the closed position.

2. The tablet splitter of claim 1, wherein the hinged connection is integral to the respective first and second portions.

3. The tablet splitter of claim 1, wherein the hinged connection comprises corresponding hinge sections on each of the first and second portions, and wherein the corresponding hinge sections are operably joined together with a pin.

4. The tablet splitter of claim 1, wherein the angle is acute.

5. The tablet splitter of claim 4, wherein the angle is between 80 and 90 degrees.

6. The tablet splitter of claim 1, further comprising a tablet holding area formed into the second cavity.

7. The tablet splitter of claim 1, wherein the flexible matrix is a foam.

8. The tablet splitter of claim 1, wherein the wedge is non-metallic.

9. A tablet splitter, comprising:

a top portion comprising a splitting wedge, the splitting wedge comprising first and second angled sides, the first and second angled sides defining a leading edge; and a bottom portion comprising a platform, the platform comprising a cushion and a flexible tablet stabilizer disposed atop the cushion, the flexible tablet stabilizer for holding a tablet;

wherein:

the flexible tablet stabilizer comprises:

a first pair of planar upper surfaces;

a second pair of planar lower surfaces offset from and parallel to the first pair of planar surfaces; and a groove intersecting the respective first and second pairs of planar surfaces;

wherein the second pair of planar surfaces defines a seat portion for receiving the tablet, and the groove defines a wedge guide;

the cushion comprises a first material, and the flexible tablet stabilizer comprises a second material, the first and second materials being different;

the splitting wedge travels in a direction perpendicular to a horizontal plane defined by the flexible tablet stabilizer;

the leading edge of the splitting wedge contacts the tablet and causes the cushion and the flexible tablet stabilizer to flex; and the tablet splits in response to the contact with the splitting wedge upon receiving a sufficient amount of force.

10. The tablet splitter of claim 9, wherein the top portion is operably connected to the bottom portion.

11. The tablet splitter of claim 10, wherein the top portion is hingedly connected to the bottom portion via a hinge.

12. The tablet splitter of claim 11, wherein a first portion of the hinge is integrally formed with the top portion, and a second portion of the hinge is integrally formed with the bottom portion.

13. The tablet splitter of claim 9, further comprising a holding area in the bottom portion, the holding area being configured to hold one or more portions of a tablet.

14. The tablet splitter of claim 9, wherein the first material forming the cushion is softer than the second material forming the flexible tablet stabilizer.

15. The tablet splitter of claim 9, wherein the splitting wedge is non-metallic.

16. The tablet splitter of claim 9, wherein the cushion is a foam.

17. A method of uniformly splitting a tablet, comprising:

providing a tablet splitter, the tablet stabilizer comprising:

a top portion comprising a splitting wedge, the splitting wedge comprising first and second angled sides, the first and second angled sides defining a leading edge; and a bottom portion comprising a platform, the platform comprising a cushion and a flexible tablet stabilizer disposed atop the cushion, the flexible tablet stabilizer for holding the tablet;

wherein:

the flexible tablet stabilizer comprises:

a first pair of planar upper surfaces;

a second pair of planar lower surfaces offset from and parallel to the first pair of planar surfaces; and a groove intersecting the respective first and second pairs of planar surfaces;

wherein the second pair of planar surfaces defines a seat portion for receiving the tablet, and the groove defines a wedge guide;

the cushion is formed of a first material, and the flexible tablet stabilizer is formed of a second material, wherein the first and second materials are not the same; and the top portion is operably coupled to the bottom portion;

placing the tablet on the flexible tablet stabilizer;

moving the top portion such that the leading edge of the splitting wedge contacts the tablet and causes the cushion and the flexible tablet stabilizer to flex; and providing a sufficient amount of pressure to the top portion until the tablet splits into a first portion and a second portion in response to the contact with the splitting wedge.

18. The method of claim 17, wherein the first material forming the cushion is softer than the second material forming the flexible tablet stabilizer.

* * * * *